United States Patent [19]

Reid

[11] 3,930,350

[45] Jan. 6, 1976

[54] PACKAGING ASSEMBLY AND PROCESS

[75] Inventor: Philip L. Reid, Duncan, S.C.

[73] Assignee: W. R. Grace & Co., Duncan, S.C.

[22] Filed: Nov. 29, 1974

[21] Appl. No.: 528,291

[52] U.S. Cl. ..... 53/22 A; 53/86; 53/112 A

[51] Int. Cl.[2] ..... B65B 31/02

[58] Field of Search ..... 53/22 A, 112 A, 86

[56] References Cited

UNITED STATES PATENTS

| | | | |
|---|---|---|---|
| 2,565,444 | 8/1951 | Waters | 53/112 A |
| 3,736,721 | 6/1973 | Wolfelsperger | 53/22 A |

*Primary Examiner*—Travis S. McGehee

*Attorney, Agent, or Firm*—John J. Toney; Richard G. Jackson; William D. Lee, Jr.

[57] ABSTRACT

The invention disclosed is directed to a packaging assembly including a body having an open channel for supporting a trough-shaped web having a product disposed therein; a cover cooperable with the body and the web to form a substantially air-tight chamber about the product, at least one of the body and the cover having a hole for aid in vacuumizing the chamber; means for moving the body and cover into and out of chamber-forming relation; and means operable within the chamber for sealing the web to form a sealed web package containing the product. A process for packaging is also disclosed.

29 Claims, 9 Drawing Figures

FIG. 3
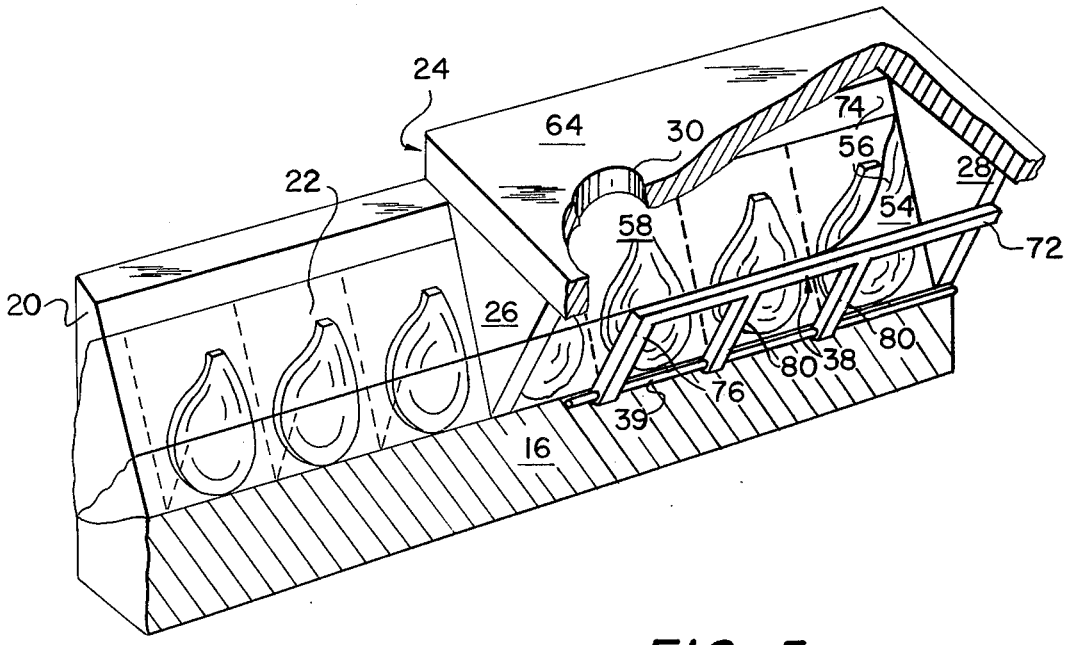
FIG. 5
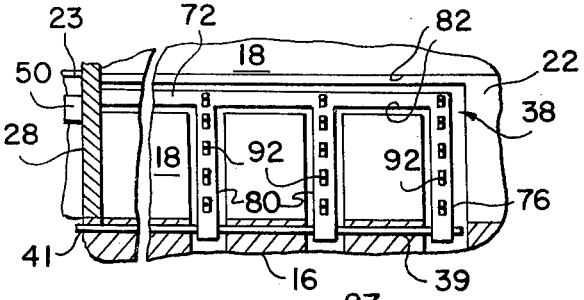
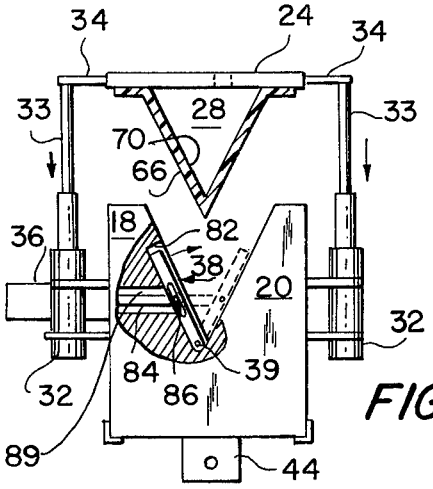
FIG. 4
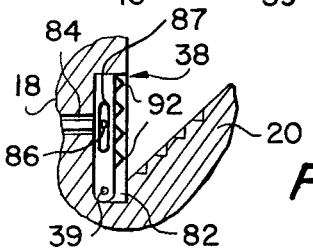
FIG. 6
FIG. 7
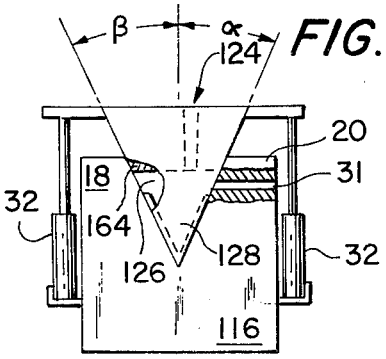
FIG. 8
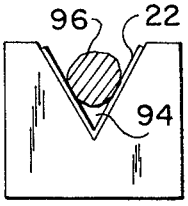
FIG. 9
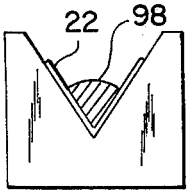

PACKAGING ASSEMBLY AND PROCESS

The present invention relates to a process and apparatus for packaging one or more products in substantially hermetically sealed packages.

Numerous methods and machines are known for forming hermetically sealed packages.

U.S. Pat. No. 3,736,721 to Wolfelsperger discloses a method and apparatus for packaging using a chamber formed of a pair of U-shaped members disposed at right angles to each other. As described therein, the film is heated by causing at least a portion of the film to be moved into contact with the inner surface of the chamber by means of a pressure differential. A single web of film is engaged by the members, which are entirely separated thereby. Thus a substantial portion of the wrapping material does not wrap the product being packaged.

U.S. Pat. No. 3,331,185 to MacKay et al. discloses a wrapping machine which comprises means for carrying a roll of heat sealable web material, folding means for forming the web into a U-shaped trough, means for maintaining the free edge portions of the web trough in spaced apart relation, means for bringing together and gripping the free edge portions of the web trough with the articles therein to be wrapped, and longitudinally carrying the thus closed web to a heat sealing and severing station, means for heat sealing and severing the loaded web perpendicular its length in the spaces between articles and means for heat sealing and severing the loaded web to free the completely wrapped article therefrom. U.S. Pat. No. 3,466,844 to L. M. Reid et al. discloses an asserted improvement on the machine disclosed in the above-cited U.S. Pat. No. 3,331,185, including addition of a horizontal conveyor for supporting the loaded packaging material.

U.S. Pat. No. 3,481,099 to Clancy et al. discloses a method for making sealed packages containing towelettes which comprises forming a moving continuous strip of moisture-proof envelope material into substantially channel shape with the upper end open, inserting towelettes into the channel at longitudinally spaced locations in timed relation with movement of the strip, sealing opposite sides of the inserted towelettes to form individual compartments therefor, injecting volatile liquid into each compartment, sealing the strip along the upper ends of said compartments, and then separating along selected areas into individual dual sealed compartmented packages.

U.S. Pat. No. 3,453,799 to Cloud et al. discloses a machine and method for continuously forming a series of filled packages from a continuous length of flexible material formed into a double wall strip using a plow. Individual pouches are severed prior to sealing the upper open ends.

U.S. Pat. No. 3,673,760 to Canamero et al. discloses another packaging machine for making hermetically sealed packages from which air has been exhausted from two continuous sheets of flexible packaging material.

U.S. Pat. No. 3,701,229 to Zelnick discloses a continuous motion skin-packaging machine and method for production of air-evacuated see-through film-on-film packages.

U.S. Pat. No. 2,753,671 to DePuy et al., discloses a machine for vacuum packaging, operation of which includes feeding a cover sheet to overlay a base sheet and merchandise units supported thereon, sealing three sides about the units, evacuating the incomplete packages through a horizontal nozzle over and beneath which are fed the cover sheet and base sheet, respectively, and sealing the fourth sides.

U.S. Pat. No. 3,693,319 discloses a method and apparatus for wrapping wherein slices of product are carried upon a web of film which is thereafter drawn through enfolding operations to entube the slices.

U.S. Pat. No. 3,420,035 discloses an apparatus having means for inserting articles into a folded web of heat-sealable material.

U.S. Pat. No. 3,283,740 discloses a method and apparatus for wrapping wherein film is wrapped around goods to form a length of an incompletely longitudinally closed tube which is provided with transverse welded seams.

U.S. Pat. No. 3,583,129 discloses an auxiliary air-evacuating apparatus for a continuous skin packaging machine.

U.S. Pat. No. 3,272,746 discloses a packaging method and apparatus wherein units to be packaged are placed on a film which is thereafter formed into a closed tube using a pair of spaced film folding shoes and a horizontally wedge-shaped hood shaped to fit over and enclose the opening between the shoes. A lance is joined with a vacuum block mounted adjacent an end of the hood for withdrawing gas from the tube.

U.S. Pat. No. 3,417,544 to Grevich discloses a former for shaping and directing a web of material around articles.

U.S. Pat. No. 3,372,797 to Grevich discloses a method of forming a perforated strip package from a folded strip of thermoplastic material.

U.S. Pat. No. 3,597,899 to Hanson discloses a method for encapsulating materials between vertically opposed upper and lower sheets of plastic film, optionally including evacuation of air from the capsules.

However, many of the prior art devices and methods have not been entirely satisfactory for making hermetically sealed vacuum packages.

It has now been found that numerous deficiencies of the prior art are overcome by practice of the present invention which provides a new improved assembly and process for packaging in simple, efficient and economical manner.

Generally stated, the packaging assembly of the present invention includes a. a body having walls defining an elongate open channel for supporting a trough-shaped web having a product disposed within the web;
b. a cover cooperable with the body and the web to form a substantially air-tight chamber;
c. means for moving at least one of the body and the cover into and out of chamber-forming relation of the body with the cover; and
d. means operable within the chamber for sealing the web to form a sealed web package containing the product.

The assembly may be used in any position effective for packaging. Thus the channel may be upwardly open, horizontally open or directionally open in any other effective direction. Preferably, the channel is generally upwardly open. The cover includes means for maintaining at least a portion of the web in trough-shaped configuration within the chamber. At least one of the cover and the body has a hole therethrough adapted for flow communication of the chamber with vacuumizing means.

This invention also provides a process for forming a vacuum package which generally stated, includes a. forming a web into trough-shaped configuration,
b. inserting a product into the formed web,
c. registering members to provide a substantially air-tight chamber with the product-containing portion of the web within the chamber and with portions of the web spaced longitudinally from the product sealingly engaged between the members;
d. maintaining at least a portion of the web in trough-shaped configuration within the chamber;
e. vacuumizing to reduce the pressure interiorly of the chamber about the product;
f. while the chamber pressure is reduced, moving spaced apart transversely opposed portions of the web into interfacial engagement outwardly of the product, said transversely opposed web portions including at least a portion of said web margin;
g. sealing interengaged portions of the web to form a vacuum package containing the product; and
h. moving the members apart to open the chamber to permit recovery of the package; with at least a portion of one longitudinal margin of the web disposed within the chamber and substantially free of restraint against transverse movement into contact with an opposite portion of the web.

Practice of the present invention will be made more fully apparent by the following detailed description taken with the accompanying drawing wherein like numerals refer to similar elements throughout the several views.

In the drawing:

FIG. 3 is a fragmented perspective view illustrating a chamber formed by the assembly;

FIG. 4 is an end view illustrating body and cover components or members of the assembly with a sealing bar operable within the chamber;

FIG. 5 is a side view taken normal to a channel-defining wall of the body and showing the sealing bar disposed in a recess thereof;

FIG. 6 is an end view of the sealing bar showing perforating means disposed thereon;

FIG. 7 is an end view showing another embodiment cover component of the present assembly;

FIGS. 8–9 illustrate products of various shapes which may be packaged by means of the present invention.

Figures 1, 2:
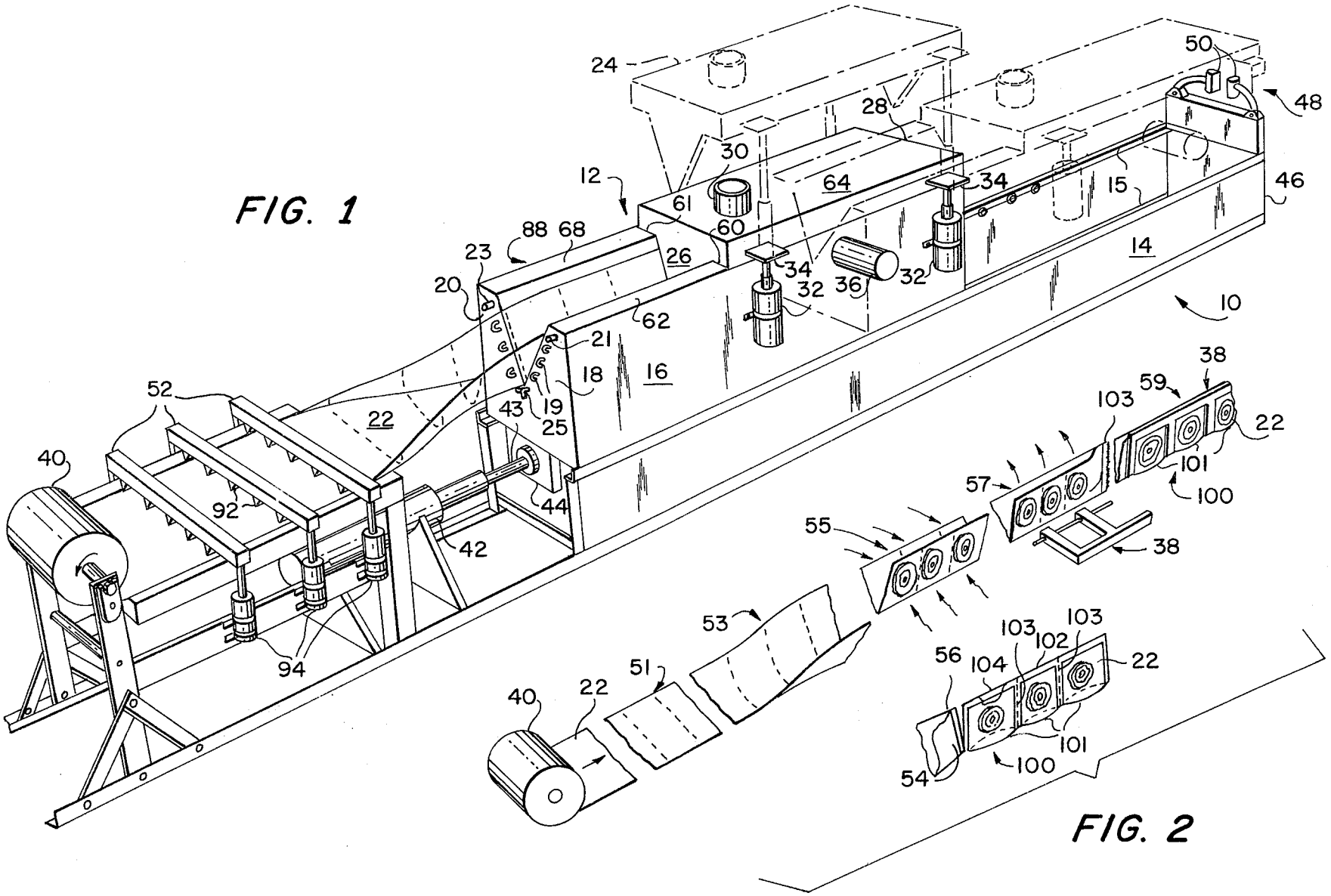
FIG. 1 is a perspective view illustrating the present packaging assembly and packaging apparatus of this invention including the assembly as a component thereof.
FIG. 2 is a perspective fragmented view schematically illustrating a web as it may appear along a path of web travel in the apparatus.

Referring now to the drawing and especially FIG. 1 there is shown packaging apparatus 10 of the present invention including vacuumizing and sealing assembly 12 slidably supported by tracks 15 provided on frame 14. The assembly includes body 16 having walls 18 and 20 defining an elongate upwardly open channel for supporting a trough-shaped web 22 of flexible sheet material, which may be supplied from supply roll 40 shown rotatably carried by the frame. The assembly includes cover 24 cooperable with the body and the web to form a substantially air-tight chamber, which cooperating relationship is shown in FIGS. 1 and 3. The cover includes depending arms 26 and 28 which provide means for maintaining at least a portion of the web in trough-shaped configuration within the chamber and for closing longitudinally opposite ends thereof. Provided in the cover is hole 30 extending therethrough and adapted for flow communication of the chamber with vacuumizing means as by way of a flexible vacuum hose not shown. Mounted on the side of the body are preferably four stroking cylinders 32, having reciprocable rods 33 connected to mounts 34 provided on the cover for moving the cover up and down and out of and into chamber forming relation of the body with the cover. Two of these cylinders are shown in FIG. 1 with two oppositely mounted stroking cylinders being substantially hidden by wall 20. An upper position of the cover is illustrated by the upper phantom view shown in FIG. 1.

Although in the illustrated arrangement the stroking cylinders operate to move the cover while the body is supported on a frame, it is within the scope of this invention to independently support the cover and reciprocably move the body into and out of chamber-forming relation with the cover.

As illustrated in FIGS. 3, 4, and 5, the assembly includes sealing bar 38 which is normally disposed in a recess provided in channel-defining wall 18 and may be pivotally mounted about elongate pin 39 which is disposed in the body.

Conveniently, the assembly is adapted to intermittently or semi-continuously form packages. Thus apparatus 10 includes frame supported stroking cylinder 42 having reciprocal rod 43 connected to mount 44 depending from the body, whereby the assembly is reciprocably movable to the lateral phantom position shown in FIG. 1 with the exterior transverese side of arm 28 adjacent end 46 of the frame. Operably disposed adjacent the frame end 46 is brake system 48 for securing a preferably sealed portion of the web during movement of the assembly toward the roll 40 to preclude carry-back of the web toward the supply roll. The brake or gripping system includes jaws 50 which are pivotally mounted by the frame for releasably gripping and securing the web between opposed surfaces of the jaws.

FIG. 2 schematically illustrates various functions performed using the present apparatus. In operation web 22 of flexible sheet material is advanced from supply roll 40, formed into trough-shaped configuration in stage 53, loaded with one or more products and optionally pre-heated in stage 55, subjected to chamber vacuumizing in stage 57, and while in the chamber environment the web is sealed in stage 59 about one or more of the loaded or inserted products as desired. The web may be provided with transverse lines of weakness at any suitable stage, for example in stage 51 prior to formation of the trough-shaped web, as by means of perforators 52 which may be included in apparatus 10 intermediate the assembly and supply roll. Each loaded product may be an article or an aggregate of two or more articles.

In making packages, the body and the cover are placed in register to provide a substantially air-tight chamber with a product-containing portion of a web within the chamber. Transverse web portions spaced longitudinally from the product are sealingly engaged between the body and cover members. Thus, a portion of the web disposed between arm 26 and body walls 18 and 20 is sealingly engaged between the arm and the walls, while a corresponding portion of the web may be engaged between arm 28 and one or more of the walls.

For semi-continuous package forming operations transversely opposed portions of the web are urged into mutual sealed contact and the resulting two-layer web portion is sealingly engaged between one of the walls and a transverse side of one of the arms as illustrated in FIG. 3, wherein opposed portions of both web walls 54 and 58 are in sealed contact each with the other and sealingly engaged between arm 28 and wall 20 adjacent an end of the chamber, and the web walls are independently sealingly engaged between transversely opposite sides of arm 26 and walls 18 and 20, respectively, at an opposite end of the chamber.

Longitudinal web margin 56 terminating to an upper edge of web wall 54 is disposed within the chamber and substantially free of restraint against transverse movement into contact with the opposite web wall or portion 58. The web, which preferably is of stretchable material, is maintained in substantially trough-shaped configuration within the chamber by means of arm 26. The chamber is vacuumized through the hole to reduce the pressure interiorly of the chamber about the one or more products, as by means of operating a vacuum pump with a hose connected from the hole to the low pressure side of the pump, not shown. While the chamber pressure is reduced to a suitable level, spaced apart transversely opposed web portions 54 and 58 are moved into interfacial engagement outwardly or peripherally of the one or more products. Transverse web movement is principally effected by pivoting the seal bar transversely of the channel. Preferably, the thus engaged web portions include at least a portion of web margin 56. In a preferred embodiment the web margin 56 is thereby engaged with the corresponding web margin of opposed web wall 58. The thus interengaged portions of the web are sealed to form one or more vacuum packages each containing a product.

Maintaining the longitudinal margin 56 substantially free from restraint against transverse movement not only effectively and substantially avoids undue stretching and weakening of the film but also maximizes utilization of the web in the package being formed, in contrast to many heretofore known vacuum packaging procedures. Such freedom from restraint of web margin 56 is provided by the present assembly in that the cover is adapted to directly engage an upper longitudinal portion of at least one of the body walls to form therewith a substantially airtight seal, as shown for example in FIG. 1, wherein undersurface 60, appearing as an edge therein, of cover 24 directly engages upper surface 62 atop wall 18. Cover 24 includes (I) spaced apart depending arms 26 and 28 adapted to substantially hermetically seal longitudinally opposite portions of the chamber with portions of the web engaged between the arms and the channel and (II) bridge 64 connecting the arms and adapted to directly engage the body to substantially hermetically seal an upper portion of the channel.

The channel and the depending arms of the cover are preferably of generally V-shape in transverse section, as shown. However, mating arrangements of generally U-shaped channels and depending arms may also prove useful. The generally V-shaped arms and channels may be formed with mating arcuate portions joining their respective tapering side portions which correspond to the legs of a V.

Desirably, transversely opposed sides of the arms include resilient sealing means illustrated in FIG. 4 by a portion of strip 66 of suitable resilient material which may be foam rubber. The bridge includes undersurface portions 60 and 61 extending longitudinally from one of the arms and terminating to the other arm, the body including upper surfaces 62 and 68 atop the walls and extending outwardly from the channel defining surfaces, whereby the bridge undersurfaces are sealingly engagable with the body upper surfaces in chamber forming relationship of the cover with the body. Transversely facing side 70 of arm 28 is preferably adapted in any suitable manner to directly sealingly engage the channel, as by providing the channel and the arm side with highly finished mating surfaces or providing the arm side with resilient sealing means disposed thereon and forming a part thereof. The arm may thus be adapted to directly engage and seal with the channel substantially along the entire length of an arm side. As a general preference a strip of resilient sealing material is disposed in a closed loop entirely along a loop portion of the cover surface which sealingly engages the channel-containing body. Thus strip 66 is preferably a closed loop extending along undersurfaces 61 and 62 of the bridge and the transversely opposed tapering sides of arms 26 and 28. The strip may be secured to the cover using any suitable securing means, e.g., adhesives.

The sealing bar 38 preferably includes means, illustrated by longitudinal bar section 72, for sealing an upper longitudinal margin of a first portion of a web, such as margin 56 of web 54 to an opposite web portion, such as portion 58 and preferably to upper margin 74 thereof. The sealing bar further includes leg 76 depending preferably from an end of bar section 72, thereby providing a generally L-shaped sealing bar. In embodiments hereof L-shaped sealing bars are suitable for forming a single package per sealing stage about a product inserted into a web trough, an opposite end of which has previously been sealed. One or more leg portions 80 depending from serially spaced apart regions of elongate bar section 72 are desirably provided, thereby providing means for effectively forming two or more product packages in a single vacuumizing and sealing operation. The sealing bar may include *N* such leg portions 80 where *N* is zero or an integer, the free ends of the various leg portions preferably being pivotally mounted adjacent the bottom of the channel.

Sealing bar 38 is preferably normally disposed in recess 82 provided in channel defining wall 18, the recess being of sufficient depth such that the sealing bar is at least flush with the wall and preferably recessed therefrom in the normal position as shown in FIGS. 4 and 5. Sealing bar 38 is pivotally mounted about pivot pin 39 extending through pivot receiving holes disposed through the various seal bar legs adjacent ends thereof. To effect sealing, the sealing bar is pivoted about the pin toward and substantially to opposite wall 20 by means of actuating the stroking cylinder 36 such that rod 84 traverses a substantially transverse width of the channel. The rod may be provided with wheel 86 rotatably mounted adjacent an end thereof for rotatably and slidably engaging groove 87 provided in the associated seal bar leg for positive reciprocable motion of the seal bar between a sealing position adjacent wall 58 and the normal or recessed position. Rod 84 is reciprocably disposed through cavity 89 extending from an outer side of wall 18 to the recess.

A web having one or more products inserted therein to be vacuumized and sealed in the present assembly may be positioned in the channel of the body in any suitable manner.

Thus, for example, the web may be formed into a trough within the channel with the cover raised therefrom as illustrated in FIG. 4. Thereafter one or more products may be inserted into the trough-shaped web, after which the cover is closed to form the chamber and vacuumizing and sealing may be effected as above described. Thus the channel may be substantially equal in length to the distance from the outer face of a first channel closing cover arm to the outer-face of an opposite channel closing cover arm. However, for higher packaging speeds and improved ease of operation, it is desirable to construct the channel of greater length than the distance between depending arms 26 and 28, thereby providing a channel having a loading station terminating to the chamber-forming portion of the channel. Preferably, the loading station portion of the channel, illustrated by station 88 in FIG. 1, is slightly greater in length than the length of the chamber-forming portion of the channel.

In operation of the thus illustrated and preferred apparatus, assembly 12 may be stroked initially to end 46 of the frame with the chamber-forming portion of the assembly adjacent the frame end having the web gripping or brake system. The cover may be thereafter stroked upwardly to expose the channel and a sufficient length of web material is withdrawn from the roll such that a continuous length of web extends from the roll to the gripping system, whereupon the jaws are closed to grip the web. At least one heat seal 103 is provided entirely transversely of the web as shown in FIG. 2, and a first set of one or more products is inserted into the web at suitably spaced apart positions longitudinally of the web in loading station 88 now disposed centrally of the opposite track ends. Next, while maintaining the grip on the web, the assembly with the cover in an upper position is advanced along tracks 15 toward web roll 40 by means of stroking cylinder 42, the assembly body now appearing as shown by the hold lines in FIG. 1 and the assembly cover now appearing as shown by the upper phantom position thereof in FIG. 1. The grippers may be opened now or subsequently. By thus moving the assembly towards the web roll an unloaded portion of the web is received into the loading station with simultaneous formation of this web portion into trough-shaped configuration, into which web trough a second set of one or more product units is next inserted in suitably spaced apart relationship longitudinally of the web. The last-described advance of the assembly effectively transfers the web portion having the first set of products inserted therein from the loading station to the chamber-forming portion of the body channel, which is now disposed centrally of the opposite track ends. The cover is thereafter registered with the body by stroking the raised cover down into substantially air-tight chamber forming relation with the body and with portions of the web spaced longitudinally from the products sealingly engaged between the cover arms and the body wall, as illustrated, for example, in FIG. 3. The web is maintained in substantially trough-shaped configuration within the chamber by means of engagement of the web between the cover and the arms. Thereafter the chamber is vacuumized to suitable degree of rarifaction, after which the sealing bar is pivoted within the chamber transversely of the channel to effect contact between opposing web portions about one or more of the products and sealing of the web walls adjacent the bar.

During vacuumizing the assembly desirably is again moved to the gripping system end of the apparatus, thereby advancing the web portion having exposed loaded product therein to a zone disposed centrally of the track ends, drawing a contiguous web portion to above the track section disposed closer to the web roll, and advancing the vacuumized product-containing web portion to the gripper system end of the frame. Next, the previously opened grippers 50 are moved into engagement with transverse web portion 23 adjacent arm 28 as illustrated schematically in FIG. 5, after which the cover is again raised and the cover-body assembly is again retracted or advanced to the position of the frame closer to the web roll, thereby at least partially forming a successive web portion into trough-shaped configuration in the loading station. The successively formed packages or successively formed sets of contiguous packages which result from repetition of the functions or steps set forth in the above description may be forwarded to storage or use, with or without severance thereof from the continuous web, as desired.

The heat for the heat-sealing operation may be provided by any suitable heating means. In an embodiment the sealing bar itself is heated by heating the pivot pin as by way of electric resistance heating elements provided therein and connected at exposed pin end 41 (FIG. 5) to an electric power source, not shown.

Preferably, the heating means is provided in whole or part by heating elements 19 which may be disposed in walls 18 and 20 for heating the web through the channel defining body surfaces. The elements may be conduits for steam introduced through ports 21 and 23 and removed through port 25. If desired the heating elements may be electric resistance conductors suitably connected by well known means to a source of electric power. The web is found to be suitably heated from the heated walls such that not only is sealing effected in reduced time, but also better packages generally may thus be prepared.

In a preferred embodiment perforating means are included in the apparatus as illustrated by perforators 52 each of which includes a serrated knife means 92 and is reciprocably movable into and out of cutting engagement with the web by operation of stroking cylinders 94 operatively associated therewith. The spacing between the cutting surfaces of the perforators 52 at the point of engagement with the web is substantially equal in distance to the length of the package being formed. In making a plurality of packages in a single vacuumizing and sealing operation, the perforator spacing is substantially equal in distance to the distance between axes of two or more spaced legs provided on the sealing bar. The location of the perforators and the sealing bars are indexed such that the various packages are formed with heat sealed surfaces disposed adjacently longitudinally forward and rearward sides of the lines of weakness formed by the perforators. Use of perforators 52 is desirable in that the resulting lines of weakness serve as index lines to aid in suitably indexing the products being loaded in the web. In another embodiment, lines of weakness may be provided in the web by use of a sealing bar having serrated cutting edges provided along the web contacting surface of one or more of the depending legs 78 and 80. Bar 38 may be provided with serrated cutting surfaces 92 disposed in spaced apart relationship substantially along the lengths of the various legs. As illustrated in FIG. 6, wall 20 may be provided with recesses for receiving the cutting surfaces disposed on the bar.

In another embodiment, shown in FIG. 7, the present assembly includes cover 124 having (I) spaced apart generally V-shaped depending arms 126 and 128 adapted to substantially hermetically seal longitudinally opposite portions of the chamber with portions of the web engaged between the arms and the channel and (II) truncated generally V-shaped bridge 164 connecting said arms and adapted to directly engage the body to substantially hermetically seal an upper portion of the channel, said bridge engaging the channel along transversely opposed sides of the bridge extending from arm 128 and terminating to arm 126. In this embodiment body 116 may be substantially the same as body 16 shown, for example, in FIG. 1.

A wide variety of product shapes may be packaged using the present apparatus. In FIGS. 8 and 9 there are shown illustrative product shapes 96 and 98, which are generally round and wedge shaped, respectively. Products which do not extend to the lower portion of the web, such as product 96, are found to aid in vacuumizing by maintaining an air exhaustion channel 94 within the vacuumizing chamber. Products which may be packaged effectively using the present apparatus include, for example, foods such as meat, cheese and the like, which may be either solid or semi-solid; hardware; balls; etc.

As shown in FIG. 5 the bar 38 preferably extends to substantially adjacent the cover arm 28, thereby permitting a continuous longitudinal margin seal to be formed in successive vacuumizing and sealing operations without need for a transverse sealing leg disposed operatively adjacent the arm. Typically therefore widths of the web contacting surfaces of the seal bar legs are greater than the width of the cover arm remote to the web supply. For packaging wherein more than two product units are simultaneously vacuumized and sealed in the chamber, and where the products are of substantial channel filling size as indicated by product 96 in FIG. 8, it is preferred in order to minimize web distortion that the seal bar end leg 76 be spaced from the inner transverse surface of depending arm 26 a suitable distance, which may be for example equal in length to the distance from arm 76 to that arm 80 nearest thereto.

While resilient means 66 have been illustrated disposed on the cover it is within the scope of the present invention to provide the resilient means on the surfaces of the body which engage or substantially engage with the cover to provide a substantially air-tight chamber.

Packages which may be formed using either the present process or apparatus are illustrated by strip package 100 (FIG. 2) which includes a plurality of severable package units 101 joined along transverse lines of weakness 103 having transverse heat seals disposed adjacent thereto. The packages include an upper heat seal desirably disposed along an upper end of the web 22 wherein longitudinal margin 102 is heat sealed to opposite longitudinal margin 104.

The web is preferably formed of a stretchable sheet material suitable for packaging which desirably is of see-through construction. The sheet material may be sufficiently thin, for example, up to about 3 mils in thickness, as to be classified as a film. The film or other sheet material may be of any suitable material, including, for example, polyethylene coated with an ethylene vinyl acetate interpolymer on the surfaces to be contacted in heat-sealing; laminates such as those including a high barrier layer such as poly(vinylidene chloride) and copolymers including from about 50 to about 85 weight percent thereof; polypropylene; polybutene, preferably polybutene-1; and the like.

The angles $\alpha$ and $\beta$, which the transversely opposite sides of the depending cover arms make with the vertical as shown in FIG. 7 and the corresponding like identified angles of the channel-defining surfaces of the walls 18 and 20, preferably are substantially identical and may be in the range from about 1° to about 80° or more, preferably from about 5° to about 30°.

FIG. 7 further illustrates another embodiment of the present assembly wherein hole 31 is provided through the body and opening to the channel at an upper portion of wall 20, the hole being adapted for flow communication of the chamber with vacuumizing means not shown. When the present assembly is thus formed, the hole is disposed sufficiently high to avoid blocking thereof by webs received in the body channel during vacuumizing.

If desired, after vacuumizing and prior to sealing packages being formed by the present invention, various gaseous compositions may be introducted into the chamber. Suitable gaseous compositions include, for example, inert gases such as nitrogen or the like.

It is to be understood that the foregoing detailed description is given merely by way of illustration and that numerous modifications may be made therein without departing from the spirit or scope of the present invention.

What is claimed is:

1. A packaging assembly comprising a. a body having walls defining an elongate open channel for supporting a trough-shaped web having a product disposed within the web;

b. a cover cooperable with the body and the web to form a substantially air-tight chamber, said cover including means for maintaining at least a portion of the web in trough-shaped configuration within the chamber, at least one of said body and said cover having a hole therethrough adapted for flow communication of the chamber with vacuumizing means;

c. means for moving at least one of the body and the cover into and out of chamber forming relation of the body with the cover; and d. means operable within the chamber for sealing the web to form a sealed web package containing the product.

2. The assembly of claim 1 wherein said cover is adapted to directly engage an upper longitudinal portion of at least one of said body walls to form therewith a substantially air-tight seal.

3. The assembly of claim 1 wherein said cover includes (I) spaced apart depending arms adapted to substantially hermetically seal longitudinally opposite portions of the chamber with portions of the web engaged between the arms and the channel and (II) a bridge connecting said arms and adapted to directly engage the body to substantially hermetically seal an upper portion of the channel.

4. The assembly of claim 3 wherein said channel and said arms are generally V-shaped in transverse section.

5. The assembly of claim 3 wherein transversely opposed sides of said arms include resilient sealing means.

6. The assembly of claim 3 wherein said bridge includes undersurface portions extending transversely outwardly from upper portions of the arms and extending longitudinally from one of said arms to another of said arms, said body includes upper surfaces extending outwardly from the channel defining surfaces, and said bridge undersurfaces sealingly engage the body upper surfaces.

7. The assembly of claim 3 wherein a transversely facing side of one of said arms is adapted to directly sealingly engage the channel.

8. The assembly of claim 1 wherein said sealing means includes means for sealing a first transverse portion of the web to a second transverse portion of the web and means for sealing an upper longitudinal margin of a first portion of the web to an upper longitudinal margin of a second portion of the web.

9. The assembly of claim 8 wherein the means for transversely sealing and the means for longitudinally sealing are provided by a heated sealing bar normally disposed in a recess provided in one of said channel-defining wall surfaces, said bar having a generally straight elongate portion, an end leg portion depending from an end of said elongate portion, and *N* leg portions depending from serially spaced apart regions of said elongate portion where *N* is zero or an integer, the free ends of one or more of said leg portions being pivotally mounted adjacent the bottom of the channel.

10. The assembly of claim 1 wherein the longitudinal extent of the channel is about twice as long as the longitudinal chamber-forming extent of the cover, thereby providing a loading station adjacent the chamber-forming portion of the channel.

11. The assembly of claim 10 further including means for heating the channel surfaces at the loading station.

12. Packaging apparatus comprising the assembly of claim 1 in combination with means for moving the assembly while the body and cover are not in chamber-forming relation toward a supply roll of the web material, means for securing a sealed portion of the web during movement of the assembly toward the roll to preclude carry back of the web toward the supply roll, said moving means being reversibly operable with the cover and body in chamber-forming relation for advancing web material to a loading station and for advancing loaded web material toward the securing means.

13. The packaging apparatus of claim 12 further including means disposed operatively in advance of the assembly for forming longitudinally spaced apart lines of weakness transverse the web.

14. A process for forming a vacuum package which comprises a. forming a web into trough-shaped configuration,
b. inserting a product into the formed web,
c. registering members to provide a substantially air-tight chamber with the product-containing portion of the web within the chamber, with portions of the web spaced longitudinally from the product sealingly engaged between the members, with at least a portion of one longitudinal margin of the web disposed within the chamber and substantially free of restraint against transverse movement into contact with an opposite portion of the web,
d. maintaining at least a portion of the web in trough-shaped configuration within the chamber;
e. vacuumizing to reduce the pressure interiorly of the chamber about the product;
f. while the chamber pressure is reduced, moving spaced apart transversely opposed portions of the web into interfacial engagement outwardly of the product, said transversely opposed web portions including at least a portion of said web margin;
g. sealing interengaged portions of the web to form a vacuum package containing the product; and
h. moving the members apart to open the chamber to permit recovery of the package.

15. The process of claim 14, which further includes prior to said vacuumizing step, substantially hermetically sealing a transverse portion of the web with an opposed transverse portion of the web to provide a web trough having a closed end, and wherein the chamber is formed with the closed end sealingly engaged between the members.

16. The process of claim 15 wherein the process is successively carried out using longitudinally spaced transversely joined web segments and the hermetically sealing step prior to vacuumizing a later vacuumized segment is performed by the sealing of a prior vacuumized segment.

17. The process of claim 14 wherein the formed web is generally V-shaped in transverse section.

18. The process of claim 14 wherein the web is supplied from a web supply and further including after step (c) and prior to step (h) moving the registered members with portions of the web engaged therebetween to advance the web from the web supply, and thereafter while the members are apart securing the web to substantially preclude carry back thereof toward the web supply, while the members are apart and the web is secured moving the members longitudinally of the web toward the web supply, and thereafter repeating steps (c) to (h) inclusive.

19. The process of claim 14 wherein the members include a body having walls defining an elongate upwardly open channel for supporting said trough-shaped web and a cover cooperable with the body and the web to form said substantially air-tight chamber, said cover including means for maintaining at least a portion of the web in trough-shaped configuration within the chamber, said cover having a hole therethrough adapted for flow communication of the chamber with vacuumizing means.

20. The process of claim 17 wherein said registering step includes directly engaging the cover with an upper longitudinal portion of at least one of said body walls to form therewith a substantially air-tight seal.

21. The process of claim 19 wherein said cover includes (I) spaced apart depending arms adapted to substantially hermetically seal longitudinally opposite portions of the chamber with portions of the web engaged between the arms and the channel and (II) a bridge connecting said arms and adapted to directly engage the body to substantially hermetically seal an upper portion of the channel.

22. The process of claim 19 wherein said channel, said arms, and said formed web are generally V-shaped in transverse section.

23. The process of claim 14 wherein the web is a plastic film.

24. The process of claim 23 wherein the film is of polyethylene coated with a ethylene vinyl acetate interpolymer.

25. The process of claim 23 wherein the film is a laminate.

26. The process of claim 25 wherein the laminate includes a lamina of poly(vinylidene chloride) or a copolymer including from about 50 to about 85 weight percent thereof.

27. The process of claim 14 wherein two or more product units are inserted in serially spaced apart relationship longitudinally of the formed web, the chamber is formed with two or more of said product units disposed therein, and while the chamber pressure is reduced opposed portions of the web are moved into interfacial engagement and sealed about each product unit to form contiguous vacuum packages each containing a product unit.

28. The apparatus of claim 3 wherein said bridge includes transversely opposed sides adapted to engage the body to substantially hermetically seal an upper portion of the channel.

29. The apparatus of claim 28 wherein said bridge further includes an undersurface portion extending longitudinally from one of said arms to another of said arms for forming an upper surface of the chamber.

* * * * *